United States Patent [19]

Fusen

[11] 4,197,423

[45] Apr. 8, 1980

[54] SUBMERSIBLE CABLE FOR FISH-REPELLING INSTALLATION

[75] Inventor: Hubert Fusen, Cologne, Fed. Rep. of Germany

[73] Assignee: Felten & Guilleaume Carlswerk Aktiengesellschaft, Köln-Mulheim, Fed. Rep. of Germany

[21] Appl. No.: 810,063

[22] Filed: Jun. 24, 1977

Related U.S. Application Data

[62] Division of Ser. No. 677,132, May 10, 1976, abandoned.

[51] Int. Cl.[2] ..... H01B 7/14; H01B 7/18

[52] U.S. Cl. ..... 174/107; 174/113 R; 174/114 S; 174/120 SC

[58] Field of Search ..... 174/107, 108, 120 SC, 174/113 R, 114 R, 114 S, 110 PM, 110 N, 102 R, 121 SR; 43/17.1

[56] References Cited

U.S. PATENT DOCUMENTS

| | | | |
|---|---|---|---|
| 1,904,162 | 4/1933 | Milliken | 174/114 S |
| 2,128,547 | 8/1938 | Wells | 174/113 R |
| 2,377,153 | 5/1945 | Hunter et al. | 174/120 SC |
| 3,106,815 | 10/1963 | Nance et al. | 174/102 R |
| 3,115,542 | 12/1963 | Palandri et al. | 174/102 R |
| 3,259,684 | 7/1966 | Wakefield | 174/108 |
| 3,312,774 | 4/1967 | Peterson | 174/120 SC |
| 3,621,118 | 11/1971 | Bunish | 174/121 SR |
| 3,634,607 | 1/1972 | Coleman | 174/110 PM |
| 3,681,510 | 8/1972 | Lemieux | 174/102 R |
| 3,692,925 | 9/1972 | Kindij | 174/120 SC |
| 3,710,009 | 1/1973 | Hoeg et al. | 174/113 R |
| 3,914,532 | 10/1975 | Dyba et al. | 174/114 S |
| 4,010,315 | 3/1977 | Mildner | 174/107 |

*Primary Examiner*—E. A. Goldberg
*Attorney, Agent, or Firm*—Michael J. Striker

[57] ABSTRACT

A submersible cable for a fish-repelling installation comprises a central conductive-wire core covered with a conductive smoothing layer and then with an insulating layer. A first conductive layer is applied over this first insulating layer, then a second insulating layer and a second conductive layer that constitutes a field limiter. Armor in the form of synthetic-resin strands is then wound over the cable and a waterproof layer is applied to the outside of the cable. After the application of each insulating layer the cable is tested for leakage in order to repair any discovered leaks before the next conductive layer is applied to the cable.

8 Claims, 3 Drawing Figures

SUBMERSIBLE CABLE FOR FISH-REPELLING INSTALLATION

This is a division of application Ser. No. 677,132, filed May 10, 1976, now abandoned.

BACKGROUND OF THE INVENTION

The present invention relates to a submersible cable. More particularly this invention concerns such a cable usable in a fish-repelling installation.

It has been found possible to repel fish by passing massive current pulses through a submerged conductor. Such an arrangement is used around the water intakes of power plants and the like to prevent fish from being sucked up.

Such an arrangement is also used to prevent sharks from entering swimming areas. In this type of arrangement a cable is laid across a mouth of a bay or is made to encircle a beach swimming area. A high-current pulse generator is connected to the ground (water) and to one end of the cable so as to feed high-current electrical pulses into the cable. These pulses flow through the cable to the other end and thence through the ground back to the source. The pulse shape and sequence is chosen so that the current flows along the source in an envelope surrounding the cable. This electricity in the water repels fish highly effectively, as it affects the muscles of the fish in the same manner as an electric shock affects a human being. Fish are, however, substantially more susceptible to such electrical shocks than human beings.

Such a cable is typically formed as a conductive core provided with a conductor smoothing layer and formed of a metal. A highly insulating dielectric surrounds this core and a field-limiting layer as well as armoring is normally provided on the cable.

Nonetheless, such a submersible cable is often subjected to very active or corrosive chemical attack by the seawater and considerable physical attack by the surf or underwater currents. Furthermore, the electrical field created around the cable often only increases the chemical activity of the seawater so that the so-called water-treeing effect is produced. In accordance with this effect, tiny pinpoint or hairline passages form within the insulation of the cable so that conductive leaks occur, by which are meant conductive pathways through the insulating layer. Such leaks allow the return current frequently to follow the armor of the cable and, therefore, not to be effective in the water to repel fish. It is essential that the return current flow around the cable in the water, as only this type of current envelope can be used to repel fish in the desired manner.

SUMMARY OF THE INVENTION

It is therefore an object of the present invention to provide an improved submersible cable.

Yet another object is the provision of an improved method of making such a cable.

Another object is to provide a submersible cable particularly adapted for use in a fish-repelling installation and having a long service life.

These objects are attained according to the present invention in a submersible cable of the above-mentioned general type wherein the armoring or reinforcement provided in the insulating layer of the cable or a layer on the outside of the cable is formed of a nonconductive material.

This type of arrangement can readily be used in a cable that is subjected to the pounding of the surf or heavy currents. The cable can be handled without danger of damaging the insulation and, once in place, will have an extremely long service life. In accordance with the present invention when a metallic armor winding is used it may be wrapped with a winding of a polypropylene tape. It can also be formed of a reinforced elastomer such as polychloroprene. It is also possible to use a synthetic resin such as polyurethane, polyethylene, polyester, or the like so that the armoring is completely protected from the salt water.

When the cable is going to be subjected to extremely heavy pounding it is possible in accordance with this invention to use a synthetic-resin reinforcing winding. Such a winding may be made of an aromatic polyamide constituting a monofilimentary or multifilamentary winding for the cable that is set at a very steep pitch. With such a winding an elastomeric insulating layer is provided on top of it. It is formed of polypropylene or the like. Such a reinforcement has very high strength. Since neither the reinforcement nor the layer around it is conductive, any conduction of the current pulses back through these layers is altogether impossible. Thus, the control or guiding of the current envelope which surrounds the cable is effected completely by the field-limiting layer under the armor and outside the first insulating layer provided on the cable.

Such a nonmetallic armoring as described above can be made by the reaction of m-pheylenediamine and teraphthalic acid. Such a product is produced by du-Pont under the trade designation PRD-49 and Kevlar 49. Such materials have a tear strength of more than 3,000 $N/mm^2$ and a modulus of elasticity of at least 33,000 $N/mm^2$. Thus, the cable will not stretch and will have enormous resistance to wear.

In accordance with a further feature of this invention an intermediate region of the cable is formed as an inner insulating layer and an outer conductive layer. This second conductive layer is therefore sandwiched between the inner insulating layer and the outer insulating layer and is substantially voltage-free. It therefore forms a shield around the core of the cable which separates this cable from the return current pulses on the outside of the cable. This return current pulse is guided by the outer field-limiting layer which inwardly limits this field and therefore makes the second insulating layer substantially free of any field. This eliminates the water-treeing effect, or at least limits it to an inconsequential edge zone of the outermost dielectric layer.

In accordance with yet another feature of this invention the central conductive core is formed as a multiconductor cable. This considerably reduces the skin effect so that it is possible to send relatively high current pulses through the cable without encountering disadvantageous losses. The cable according to this invention has at least two separate segments or conductors, and it is preferably divided into a plurality of separate conductors separated by means such as paper or the like into at least two different conductor groups.

This intermediate layer, in accordance with the invention, may be formed by a first insulating layer applied over the conductive layer on top of the central core, a graphite layer on top of it, a winding of conductive paper around the graphite layer, and immediately on top of this paper layer a winding of a metal foil. This produces an extremely long-lived field-limiting layer which is surrounded in accordance with this invention by a sprayed-on outer layer of a high-resistance cable dielectric such as a high-density polyethylene. In accordance with yet another feature of this invention the armor and the outer winding are bedded in a graphite layer. This serves as the outer electrode in a testing arrangement described below and protects the cable from damage during its transport and laying in place. Once it is in place the layer quickly washes away.

According to the method of the present invention the cable is made by first spraying a conductive synthetic-resin compound on the central conductor core and applying over this an insulating layer of a high-resistance thermoplastic insulating material such as high-density polyethylene. Thereafter, further conductors and insulating layers are applied. According to this invention the inner insulating layer is tested before the application of the field-limiting layer and/or the armor by means of a partial-charged measuring device.

In accordance with yet another feature of this invention the conductive intermediate layer and the outer layer of the cable dielectric are tested by the partial discharge device before the cable is completed. It is also advantageous in accordance with this invention to only apply the armor and the last insulating layer to the cable when the insulating properties of the outer cable dielectric have been also tested. This last testing can be carried out by using the above-mentioned graphite layer as the outer electrode and using the field-limiting layer or the intermediate conducting layer or even the conductor as the inner electrode. When any leak is found in the insulating material it can be repaired easily at this stage by simply painting more insulating material over the leaking location.

This production method makes it possible to ascertain at each stage whether or not the cable is going to leak and to correct the leak before it becomes impossible to do so. The partial-charged measurer described above basically comprises a tube of insulating material filled with an ionizable fluid which is maintained under a high potential as the cable is passed through it. The conductive core of the cable is grounded so that any conductive leak in the insulating layer being tested will be found with ease. Even a pinpoint leak can be found with absolute sureness by this method.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
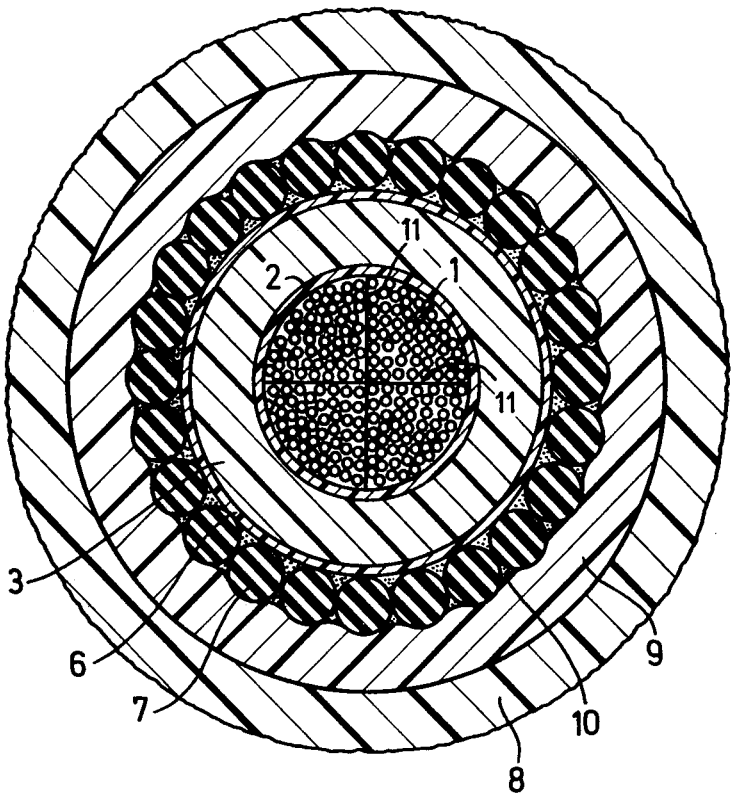
FIG. 1 is a cross section through a cable according to the present invention.

The cable shown in FIG. 1 has a central conductive core 1 formed of a multiplicity of copper conductors separated into four groups by strips 11 of insulating paper.

This conductor 1 is surrounded by a smoothing conductive layer 2 formed of polyethylene mixed with graphite or lamp black in order to render it conductive. Directly over the layer 2 there is sprayed a dielectric 3 formed of a highly resistant insulating material such as high-density polyethylene.

On the outer surface of this layer 3 there is provided a field-limiting layer 6 essentially the same as the layer 2, that is formed of a thermoplastic synthetic resin rendered conductive by addition of carbon.

A plurality of synthetic-resin strands 7 are wound at a very steep pitch over the outside of the layer 6 of the thus-layered conductor core 1. These armoring strands 7 are formed as described above of an aromatic polyamide. The interstices between the strands 7 are filled as shown at 10 with a foam or petrolatum in order to ensure the longitudinal water-tightness in this region. It is noted that the multifilament strands 7 are nonconductive. The water-tightness of the cable shown in FIG. 1 is further improved by a sealing layer 9 surrounding the armoring 7 and formed of synthetic resin or rubber, preferably a polychloroprene sold under the tradename Neoprene. Furthermore, surrounding this layer 9 is another nonconductive layer 8 formed of polypropylene filaments which give the cable considerable mechanical resistance to abrasion and wear.

Figure 2:
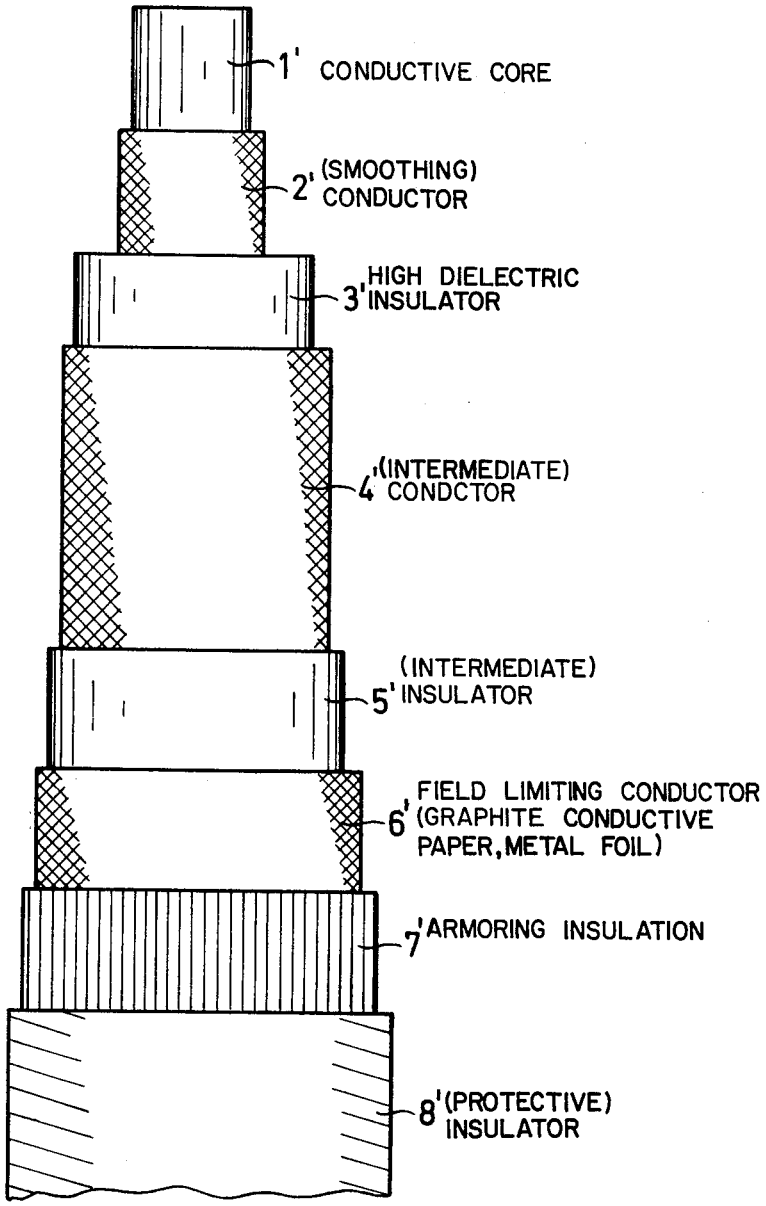
FIG. 2 is a side view of another cable in accordance with the present invention, the various layers of the cable being broken away.

The cable shown in FIG. 2 has a conductor 1′ formed of individual aluminum filaments which, due to their tight oxide coatings, are effectively insulated from one another. A conductive layer 2 similar to that shown in FIG. 1 is applied over this conductor 1′ and a thin layer 3 similar to the layer 3 is provided over top of this layer 2. In this arrangement, however, there is provided over top of the insulating layer 3 a conductive layer 4, another insulating layer 6, and then the field-limiting layer. Here the field-limiting layer 6 and the conductive layer 4 are both formed of a graphite layer, a winding of conductive paper over top of the graphite layer, and a metal conductive foil layer over the conductive-paper layer. The insulating layers 3 and 5 are here formed of a dielectric polyamide.

In FIG. 2 the armor 7′ is formed of steel-alloy wires embedded in a waterproof insulating material, such as petrolatum, and the waterproof layer 8′ that overlies it is made of Neoprene or elastomer.

It is noted that the armor of FIG. 2 could be used in the arrangement of FIG. 1 or vice versa and that the various layers and materials described with reference to FIG. 1 could be substituted in FIG. 2 and vice versa in accordance with method well known in the art.

Figure 3:
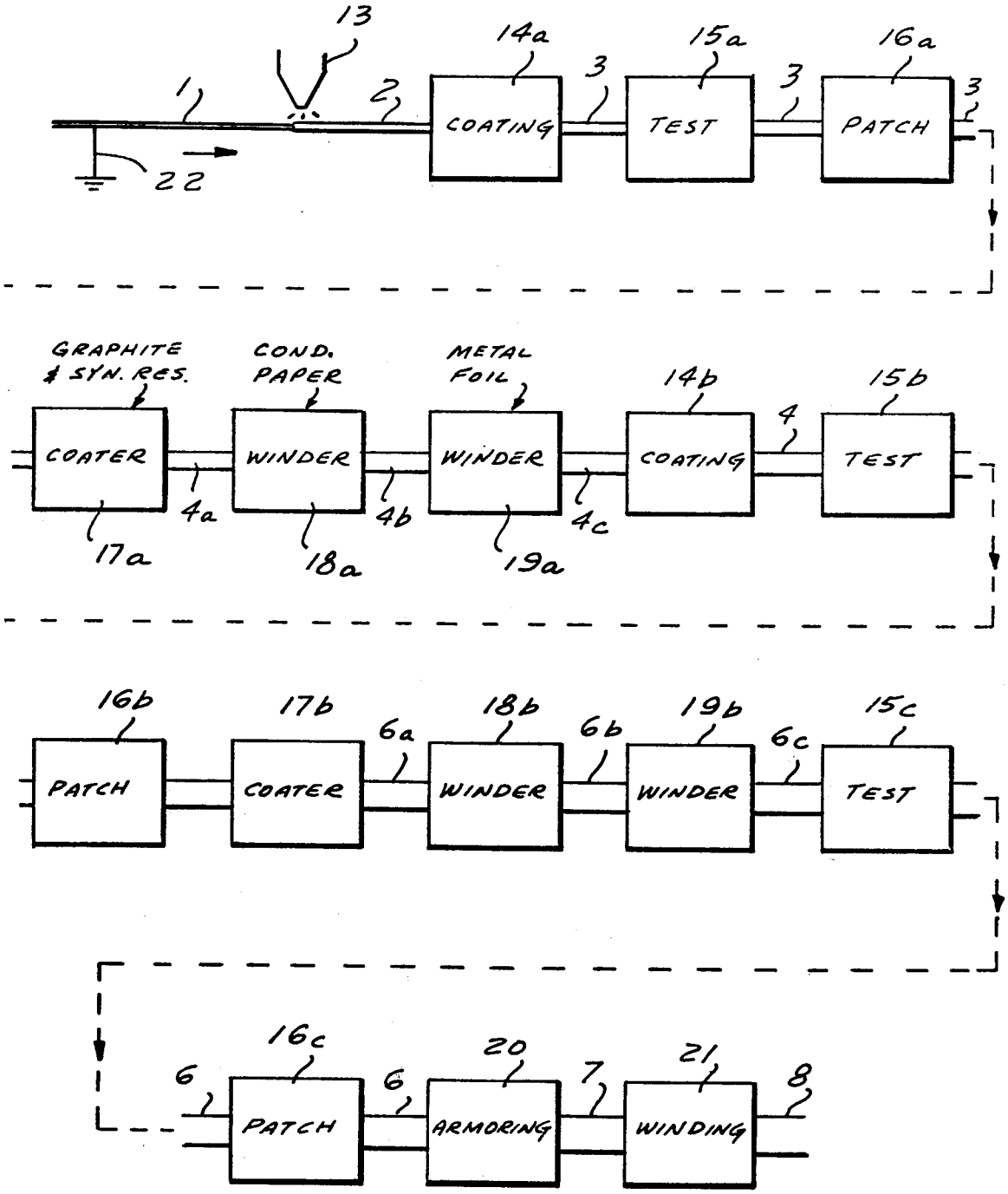
FIG. 3 is a diagrammatic view of the cable-manufacturing method according to this invention.

FIG. 3 shows the production of a cable similar to that of FIGS. 1 and 2. The conductor core 1 is first given the layer 2 by means of a sprayer 13 and then provided with the dielectric layer 3 by means of a coating device 14*a*. Thereafter the device is tested with a partial-discharge tester 15*a*, the conductor 1 being grounded as shown at 22. If a leak is found in the layer 3 it is patched by means of an arrangement 16*a* which may simply spray more of the high-density polyethylene on the leaking area. Thereafter, the insulating layer 3 is covered with a layer 4*a* of a mixture of graphite and synthetic resin by a coater 17*a*, a layer 4*b* of conductive paper is applied by a winder 18*a*, and a layer 4*c* of metal foil is applied by a winder 19*a*. Thereafter the arrangement is again coated by a coating machine 14*b* identical to the machine 14*a* and the device is tested in a device 15*b* and patched in an arrangement 16*b*. Layers 6*a*, 6*b*, and 6*c* identical to the layers 4*a*, 4*b*, and 4*c* are applied then to the layer cable by devices 17*b*, 18*b*, and 19*b*. The cable is again tested at 15*c* and patched in the arrangement 16*c*. For each of the tests at 15*b* and 15*c* it is possible to apply a voltage to the respective layer 4 or 6 in order to ascertain if there is leakage between it and any of the other layers. Thereafter the cable is armored at 20 and coated and wound at 21 to provide it with a strong dielectric skin.

It will be understood that each of the elements described above, or two or more together, may also find a useful application in other types of structure differing from the types described above.

While the invention has been illustrated and described as embodied in a submersible cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A submersible cable for a fish-repelling installation, said cable comprising a central metallic conductive core; a smoothing conductive layer surrounding said core; a discharge-proof insulating layer surrounding said smoothing conductive layer; a conductive field-limiting layer surrounding said insulating layer; and armoring insulation including a plurality of synthetic resin filaments wound around the outside of said field limiting layer and a watertight filling in the interstices between said filaments; and a discharge-proof layer of wear-resistant dielectric material of different material than the watertight filling surrounding said armoring insulation.

2. The cable defined in claim 1 wherein said filaments are made of a resin formed by an aromatic polyamide resulting from the condensation of m-phenylene diamine and terephthalic acid.

3. The cable defined in claim 1 wherein said layer of di-electric material is a polypropylene.

4. The cable defined in claim 1 wherein said core is formed of a plurality of mutually insulated and parallel conductors.

5. The cable defined in claim 1 wherein said core is formed of a multiplicity of mutually insulated conductors and means separating said multiplicity into at least two separate groups.

6. The cable defined in claim 1, wherein said field limiting layer comprises a layer of graphite on and surrounding said insulating layer, a winding of conductive paper around said layer of graphite, and a metal foil directly on and surrounding said winding.

7. A cable as defined in claim 1, further comprising an additional conductive layer surrounding said first mentioned insulating layer and an additional discharge-proof insulating layer between said additional conductive layer and said field limiting layer.

8. The cable as defined in claim 3 wherein said layer of dielectric material further includes a plurality of strands of high strength insulating material.

* * * * *